US007025029B2

(12) United States Patent
Vichinsky et al.

(10) Patent No.: US 7,025,029 B2
(45) Date of Patent: Apr. 11, 2006

(54) AIR INTAKE TUBE FOR AN INTERNAL COMBUSTION ENGINE

(75) Inventors: Kevin Vichinsky, Portage, MI (US); Brad Olson, Plainwell, MI (US); Herbert Pietrowski, Pleidelsheim (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 217 days.

(21) Appl. No.: 10/398,444

(22) PCT Filed: Oct. 10, 2001

(86) PCT No.: PCT/US01/31733

§ 371 (c)(1),
(2), (4) Date: Apr. 4, 2003

(87) PCT Pub. No.: WO02/31341

PCT Pub. Date: Apr. 18, 2002

(65) Prior Publication Data

US 2004/0040529 A1 Mar. 4, 2004

Related U.S. Application Data

(60) Provisional application No. 60/238,453, filed on Oct. 10, 2000.

(51) Int. Cl.
*F02M 35/10* (2006.01)

(52) U.S. Cl. ..... 123/184.34

(58) Field of Classification Search ..... 123/184.21–184.61

See application file for complete search history.

(56) References Cited

U.S. PATENT DOCUMENTS

| | | | | | |
|---|---|---|---|---|---|
| 3,520,284 | A | * | 7/1970 | Leopold et al. | 123/184.34 |
| 4,895,112 | A | | 1/1990 | Schneider et al. | |
| 5,564,377 | A | * | 10/1996 | Azuma | 123/184.34 |
| 5,630,386 | A | | 5/1997 | Uchida | |
| 5,839,404 | A | | 11/1998 | Numata et al. | |
| 5,992,369 | A | * | 11/1999 | Mehne | 123/184.21 |
| 6,199,530 | B1 | * | 3/2001 | Brassell et al. | 123/184.34 |
| 6,357,411 | B1 | * | 3/2002 | Aoki | 123/184.24 |
| 6,422,221 | B1 | * | 7/2002 | Pietrowski et al. | 123/568.17 |
| 6,622,682 | B1 | * | 9/2003 | Ikuma et al. | 123/184.34 |

FOREIGN PATENT DOCUMENTS

| | | | |
|---|---|---|---|
| DE | 198 30 379 | A | 2/1999 |
| EP | 802 321 | A | 10/1997 |

* cited by examiner

*Primary Examiner*—Marguerite McMahon
(74) *Attorney, Agent, or Firm*—Crowell & Moring LLP

(57) ABSTRACT

An air intake, especially for internal combustion engines with a V-shaped cylinder arrangement, which is composed of two units (16*a*, 16*b*). From the two units (16*a*, 16*b*) extend the intake ducts (19*a*, 19*b*), each associated with one cylinder bank (11) of the internal combustion engine. By dividing the air intake device into two units (16*a*, 16*b*), the unit (16*a*) can be mounted first on the internal combustion engine, a free space (20) for the mounting tool being necessary. Then the unit (16*b*) is placed and bolted on, the air intake ducts (19*b*) being able to run through the free space (20) in the hatched area (23), since the unit (16*a*) is already installed. The advantage of this air intake tube configuration is a substantially greater geometric freedom of design.

10 Claims, 2 Drawing Sheets

AIR INTAKE TUBE FOR AN INTERNAL COMBUSTION ENGINE

BACKGROUND OF THE INVENTION

The invention relates to an air intake tube for an internal combustion engine which especially has two cylinder banks in a V arrangement.

Air intake tubes of the kind described above are known. For example, EP 352 820 A1 (=U.S. Pat. No. 4,981,115) shows in FIG. 2 an intake tube for an internal combustion engine with a V-shaped arrangement of the cylinders. The intake tube has two manifold chambers 14F and 14R, from which intake ducts 15F and 15R branch out. The latter are bolted with flanges 9*a* and 9*b* to the cylinder head of the internal combustion engine. FIG. 2 of this document shows a top view of the intake tube. It is clear that the intake ducts must have a geometry that permits access of a tool to screws 19. This is a requirement for automated mounting of the intake tube on the cylinder head.

Thus the geometrical possibilities for configuring the intake tube are subject to certain limiting conditions which restrict the freedom of configuration. Moreover, the intake tube must be made with high accuracy since it must be supported at two different areas of the internal combustion engine by its cylinder head flanges.

SUMMARY OF THE INVENTION

It is therefore an object of the invention to provide an intake tube which offers very great freedom for the configuration of the intake ducts.

It is also an object of the invention to provide an intake tube which can be manufactured at moderate cost.

These and other objects are achieved by the present invention by providing an air intake tube for an internal combustion engine having at least two banks of cylinders, especially in a V array, wherein the air intake tube includes a first group of intake ducts for one cylinder bank and a second group of intake ducts for another cylinder bank; the intake tube comprises two units joined releasably together, the first unit containing the first group of intake ducts and the second unit containing the second group of intake ducts, and the volumes formed by the two units communicate with one another.

In accordance with further aspects of the invention, the objects are also achieved by providing an air intake tube for an internal combustion engine, wherein the air intake tube comprises two units joined releasably together, the volumes formed by the two units communicating with one another, while the releasable connection comprises a plug-in junction which is sealed by a gasket relative to the surrounding environment, and the gasket has a failure pressure limit which is lower than the bursting pressure of the intake tube.

The air intake tube of the invention is especially suited for an internal combustion engine with the cylinder banks in a V arrangement. To correspond to the cylinder banks, the intake ducts are divided into a first and second group. It is also possible within the scope of the invention to configure the intake tube for an internal combustion engine with cylinders in a W arrangement. In this case the intake ducts must be divided into three groups to correspond to the arrangement of the cylinders.

The intake tube of the invention is characterized in that the tube is comprised of two units joined releasably together. The units contain the respective groups of intake ducts. The units then are connected together such that the volumes formed by the two units communicate with one another. Air can be readily introduced into the intake tube through a central inlet. The air flows from this inlet through manifold chambers and thence through the intake ducts to duct outlets at the cylinders. Of course, it is also possible within the scope of the invention to provide a plurality of inlets for the combustion air.

By dividing the intake tube into two units, the freedom of configuration of the intake tube geometry can be advantageously increased without substantially increasing the number of units. Especially when the units are to be made by casting, the complexity of the two components is reduced to a special degree, so that they can more simply be made in molds.

According to one specific embodiment of the invention, the intake tube has two or more manifold chambers. In the case of a V arrangement of the cylinders, an especially practical solution is achieved by providing two manifold chambers. The aforementioned two groups of intake passages or ducts extend from these chambers to the cylinder banks. The two units are releasably attached to each other such that the two manifold chambers communicate with one another. In such a case, interactions between the two manifold chambers can be utilized in order to improve the intake performance of the tube. Each of the manifold chambers furthermore has smaller dimensions than a single chamber intended for all of the intake ducts would have, so that a greater rigidity can be achieved in the intake tube.

In accordance with one specifically preferred embodiment of the intake tube of the invention, the units are joined together by a plug-in connection or a flanged joint. These joints are releasable and are easy to handle when mounting the intake tube. Use of a plug-in connection additionally permits compensation of dimensional inaccuracies between the two units arising from manufacturing tolerances. This equalization of inaccuracies can be achieved, for example, by an axial shifting of the plug-in connection. In such a case the plug-in connection is configured such that a seal relative to the surrounding environment is possible in several axial positions. The plug-in connection can furthermore be designed such that a limited angular inaccuracy between the two units can be compensated. The advantage of such a configuration lies in the low tolerance requirements for manufacture of the individual units, which lowers the production costs.

In accordance with an alternative embodiment, the units joined releasably together have a gasket at the junction point, which has a pressure limit for failure. This pressure limit is selected to be lower than the bursting pressure of the intake tube. Consequently, the gasket additionally serves the purpose of a safety valve in case the internal combustion engine reaches an unacceptable operating condition. In this case failure of the intake tube resulting in an explosive accident is avoided. Using the gasket to relieve excess pressure represents a substantially lower hazard potential. Also, after the failure the gasket can be replaced with a low-cost repair gasket, while failure of the complete intake tube would necessitate more expensive reconstructive measures.

In one preferred embodiment, the manifold chambers of the two units communicate with one another through two releasable connections. In this case the interactions between the two manifold chambers can be utilized in a special manner. In one of the two connections a resonance valve can be disposed which can be opened or closed depending on the load on the internal combustion engine. Using such a valve the duct geometry can be varied to adjust the conditions under which the intake tube loads or charges the internal combustion engine with intake air. Arranging a resonance valve in one of the two connections also permits this comparatively complex component to be installed in the intake duct in a comparatively simple manner. Easy replacement in case of component wear or failure is likewise facilitated.

It is especially advantageous to provide a plug-in joint and a flanged joint for connecting the two units to form the intake tube. The flanged connection permits the two units to be reliably fixed to each other, for example by bolting. The plug-in joint can be designed to offset dimensional inaccuracies arising from manufacturing tolerances etc., so that tolerances between the two units can be compensated. The use of two connections can be combined with the use of a resonance valve in order to achieve the above-described advantages for the charging of the internal combustion engine.

Another advantage of the intake tube units according to the invention is that the second unit can be arranged such that it lies in a workspace required for tools used to mount the first unit to the internal combustion engine. This requires that it be possible to attach the second unit to the already installed first part, i.e., the fasteners for mounting the second unit on the first unit must be accessible after the first unit is mounted on the internal combustion engine. In this manner the geometric freedom of configuration is greatly improved, especially for the course of the intake ducts of the second part. This has manufacturing advantages, since more possibilities exist, for example, for paying attention to questions such as where to locate the parting plane of the molds used to form the parts. Also the duct unit can be designed to produce better intake air flow conditions due to the free selectability of the duct geometry. In particular, the free selectability of the duct geometry makes it easier to satisfy the requirement that the intake ducts for all the cylinders be the same length.

It is advantageous to manufacture the air intake tube from synthetic resin material or plastic. The intake tube may be produced, e.g., by injection molding. The result is light weight intake tubes manufactured at low cost. A preferred embodiment is obtained by making the units with multiple-shell molds. By using two units, each of the units can be constructed from, for example, two shells without great expense, thus forming the entire intake tube from a total of four molded shells. Thus the manufacturing costs can be kept within reasonable limits. The connection of the individual shells can be accomplished by welding or adhesive bonding. It is especially desirable to join the shells by vibration welding.

These and other features of preferred embodiments of the invention, in addition to being set forth in the claims, are also disclosed in the specification and/or the drawings, and the individual features each may be implemented in embodiments of the invention either individually or in the form of subcombinations of two or more features and can be applied to other fields of use and may constitute advantageous, separately protectable constructions for which protection is also claimed.

BRIEF DESCRIPTION OF THE DRAWINGS

The invention will be described in further detail hereinafter with reference to illustrative preferred embodiments shown in the accompanying drawings in which.

DETAILED DESCRIPTION OF PREFERRED EMBODIMENTS

Figure 1:
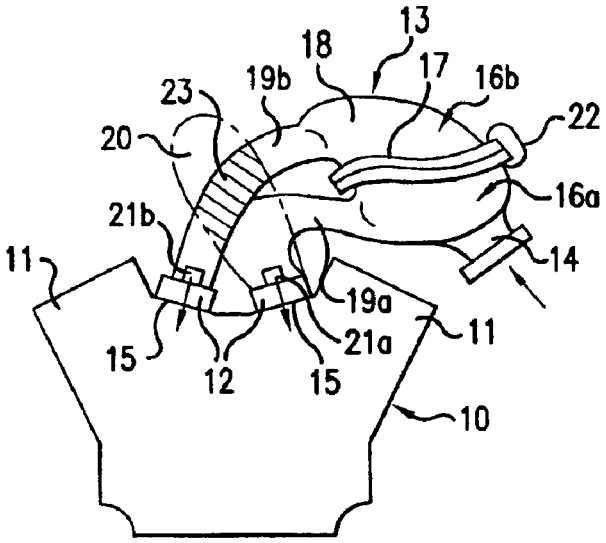
FIG. 1 is a schematic representation of an internal combustion engine with cylinders in a V configuration and an installed air intake tube.

FIG. 1 shows an internal combustion engine 10 with two cylinder banks 11 in a V array. Above the cylinder head flange 12 an air intake tube 13 is attached to the cylinder head of the internal combustion engine. Combustion air from an intake tract (not shown) enters the intake tube 13 through an inlet 14 and leaves through outlets 15.

The intake tube 13 is comprised of a first unit 16*a* and a second unit 16*b*. Together with a flange 17, the two units 16*a* and 16*b* form a manifold chamber 18 with a first set of intake ducts 19*a* extending from the lower unit 16*a* of the manifold chamber 18 and second set of intake ducts 19*b* extending from the upper unit 16*b* of the manifold chamber. These ducts 19*a* and 19*b* terminate in cylinder head flanges 12.

Figure 2:
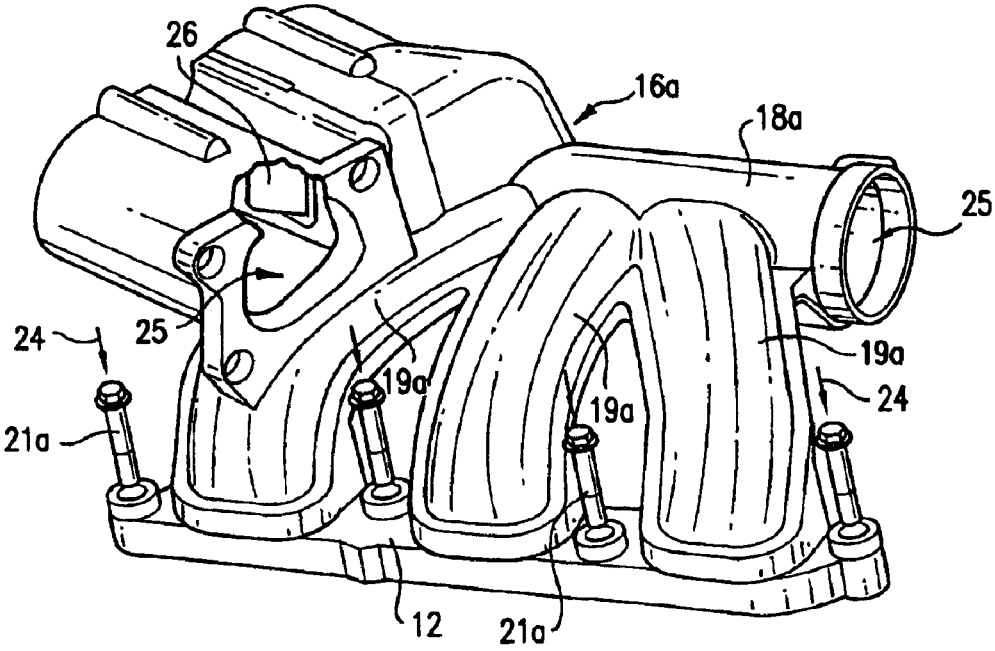
FIG. 2 is a perspective view of a first unit of a two unit air intake tube.

The intake tube 13 is mounted on the internal combustion engine 10 in the following order. First the lower intake unit 16*a* is bolted through the cylinder head flange to the cylinder head of the internal combustion engine. In order to accomplish this, the work area or assembly space 20 indicated by broken lines is necessary to enable the required assembly tools to access the mounting bolts. An automated assembly tool is inserted therein, which functions to attach the first unit 16*a* to the cylinder head with screws 21*a* which extend through the flange 12 at the ends of ducts 19*a*. After the first unit 16*a* is mounted and the assembly tool has been retracted out of work space 20, intake unit 16*b* can then be mounted on intake unit 16*a*, for example by means of attachment clamps 22. The hatched portion 23 of work space 20 needed for attaching the intake unit 16*a* is now blocked by the second set of intake ducts 19*b*. This is not a problem, however, because work space 20 is no longer needed since intake unit 16*a* is already fastened to the cylinder head of the internal combustion engine. Lastly, the intake unit 16*b* can be fastened with screws 21*b* to the internal combustion engine The intake unit 16*a* shown in a perspective view in FIG. 2 is intended for an air intake tube which is suitable for a six-cylinder internal combustion engine. The intake ducts 19*a* extend from a manifold chamber 18*a* to the cylinder head flange 12. Intake unit 16*a* is fastened with screws 21*a* to the internal combustion engine, which is not shown, the arrows 24 pointing to the needed space for an appropriate assembly tool.

The intake unit 16*a* has two junction points 25, both of which communicate with the manifold chamber 18*a*. In the broken-away part of intake unit 16*a*, a resonance valve 26 can be seen, which prevents gas flow from manifold chamber 18*a* to one of the junction points. The intake unit 16*b*, not shown, is connected to the two junction points 25 such that its manifold chamber 18*b* communicates through the junction points 25 with the manifold chamber 18*a* of intake unit 16*a*.

Figure 3:
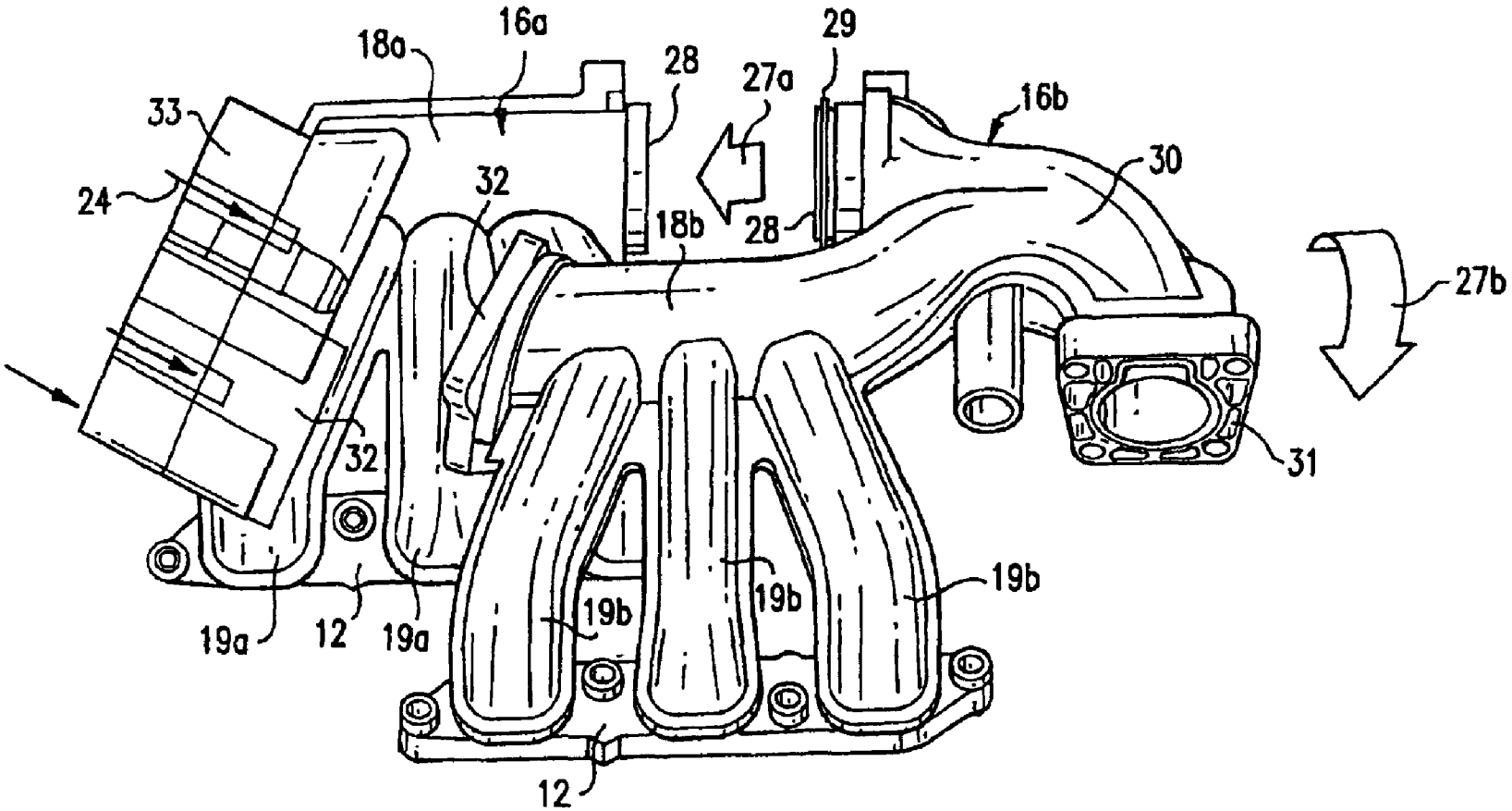
FIG. 3 is a perspective view of the assembly of a second unit on the first unit according to FIG. 2.

The attachment of intake unit 16*b* to intake unit 16*a* can be seen in FIG. 3. Broad arrows 27*a* and 27*b* indicate the movements executed by unit 16*b* as it is attached to unit 16*a* which has already been mounted on the internal combustion engine which is not shown in this figure. First, as indicated by arrow 27*a*, a plug-in connection 28 is made at one of the junction points 25 with an O-ring 29 sealing the connection. This plug-in connection brings the air intake tube 30 on unit 16*b* into communication with manifold chamber 18*a* of unit 16*a*. Intake tube 30 carries a flange 31, e.g., for connecting a throttle valve and an intake device containing the air filter. A second manifold chamber 18*b* branches off from intake tube 30, and the second set of intake ducts 19*b* extend from manifold chamber 18*b* to the other cylinder bank of the internal combustion engine. Intake ducts 19*b* likewise terminate through a common cylinder head mounting flange 12.

After the plug-in connection 28 has been made, the intake unit 16*b* can be rotated as indicated by arrow 27*b* to bring cylinder head mounting flange 12 into abutment with the cylinder head of the internal combustion engine. The cylinder head mounting flange 12 associated with the intake ducts 19*b* can be affixed to the cylinder head with bolts 21*b* as shown in FIG. 1. At the same time, the rotation of intake unit 16*b* also brings connecting flanges 32 at the other junction point 25 into abutting relation so that they can be bolted together as indicated by arrows 24.

The flanged junction 32 and the plug-in junction 28 are formed at the connection points 25 shown in FIG. 2 on the unit 16*a*. In this manner the manifold chambers 18*a* and 18*b* communicate with one another. The resonance valve 26 shown in FIG. 2 is contained in an additional volume 33 of the intake tube, which expands the two manifold chambers 16*a* and 16*b*.

Figure 4:
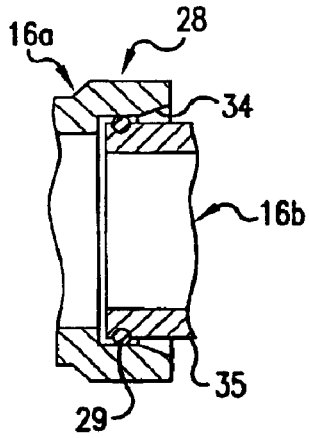
FIG. 4 is a schematic representation of a section taken through a plug-in junction between units of multi-unit intake tube.

The plug-in junction 28 is represented schematically in a sectional view in FIG. 4. An opening or receptacle 34 is formed on unit 16*a* and a plug-in nipple 35 carrying the O-ring 29 is formed on unit 16*b*. The O-ring lies in the opening 34, and the plug-in nipple 35 does not come in contact with unit 16*a*. Through use of the O-ring 29 it is possible to compensate for dimensional variations which arise due to manufacturing and assembly tolerances. Moreover, the O-ring 29 can serve as a kind of pressure relief valve in case the pressure in the air intake tube becomes unacceptably large. This can happen, for example, in the case of a backfire, i.e., the propagation of the exploding mixture from the cylinder through an unclosed intake valve into the intake tube.

The foregoing description and examples have been set forth merely to illustrate the invention and are not intended to be limiting. Since modifications of the disclosed embodiments incorporating the spirit and substance of the invention may occur to persons skilled in the art, the invention should be construed broadly to include all variations falling within the scope of the appended claims and equivalents thereof.

What is claimed is:

1. An air intake tube for an internal combustion engine with at least two banks of cylinders, said air intake tube including a first group of intake ducts for one of the two cylinder banks and a second group of intake ducts for the other of the two cylinder banks, wherein said intake tube comprises two units joined releasably together, one of said two units comprising the first group of intake ducts and the other of said two units comprising the second group of intake ducts; wherein said two units define respective first and second interior volumes which communicate with one another, and wherein the respective interior volumes defined by the two units communicate with one another through two releasable junctions, and a resonance valve is arranged in one of the two junctions.

2. An air intake tube according to claim 1, wherein said plug-in junction compensates for dimensional variations in said units due to manufacturing tolerances.

3. An air intake tube according to claim 1, wherein said two releasable junctions comprise a plug-injunction and a flanged junction.

4. An air intake tube according to claim 1, wherein the air intake tube is made from synthetic resin material by an injection molding method.

5. An air intake tube according to claim 4, wherein at least one of the units comprises an assembly of a plurality of molded shells.

6. An air intake tube according to claim 5, wherein said plurality of molded shells are welded together to form said assembly.

7. An air intake tube according to claim 1, wherein said intake tube is for an internal combustion engine having two banks of cylinders arranged in a V array.

8. An air intake tube for an interval combustion engine with at least two banks of cylinders, said air intake tube including a first group of intake ducts for one of the two cylinder banks and a second group of intake ducts for the other of the two cylinder banks; wherein said intake tube comprises two units joined releasably together, one of said two comprising the first group of intake ducts and the other of said two units comprising the second group of intake ducts; wherein said two units define respective first and second interior volumes which communicate with one another; wherein one of said units when joined to the other extends at least partially into a work space for an assembly tool for attaching the other unit to the internal combustion engine, and wherein the one unit can be attached to the other unit after the other unit is attached to the internal combustion engine.

9. An air intake tube for an internal combustion engine with at least two banks of cylinders; said intake tube including a first group of intake ducts for one of the two cylinder banks and a second group of intake ducts for the other of the two cylinder banks; the first group of intake ducts extending from a first manifold chamber and the second group of intake ducts extending from a second manifold chamber; wherein said air intake tube comprises first and second units joined releasably together; said first unit comprising said first group of intake ducts and said first manifold chamber, and said second unit comprising said second group of intake ducts and said second manifold chamber, and said first and second manifold chambers communicating with one another, and wherein the respective manifold chambers of said first and second units communicate with one another through two releasable junctions, and a resonance valve is disposed in one of the two junctions.

10. An air intake tube for an internal combustion engine with at least two banks of cylinders; said intake tube including a first group of intake ducts for one of the two cylinder banks and a second group of intake ducts for the other of the two cylinder banks; the first group of intake ducts extending from a first manifold chamber and the second group of intake ducts extending from a second manifold chamber; wherein said air intake tube comprises first and second units joined releasably together; said first unit comprising said first group of intake ducts and said first manifold chamber, and said second unit comprising said second group of intake ducts and said second manifold chamber, and said first and second manifold chambers communicating with one another, and wherein said second unit when joined to said first unit extends at least partially into a work space for an assembly tool for attaching said first unit to the internal combustion engine, and wherein said second unit can be attached to said first unit after said first unit is attached to the internal combustion engine.

* * * * *